US006976458B2

(12) United States Patent
Osburg et al.

(10) Patent No.: US 6,976,458 B2
(45) Date of Patent: Dec. 20, 2005

(54) TWO-STROKE ENGINE

(75) Inventors: Gerhard Osburg, Kernen (DE); Wolfgang Luithardt, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/948,226

(22) Filed: Sep. 24, 2004

(65) Prior Publication Data

US 2005/0072388 A1 Apr. 7, 2005

(30) Foreign Application Priority Data

Oct. 2, 2003 (DE) ..... 103 46 048

(51) Int. Cl.[7] ..... F02B 33/04
(52) U.S. Cl. ..... 123/73 PP; 123/65 V
(58) Field of Search ..... 123/73 PP, 65 V, 123/73 SP, 65 A

(56) References Cited

U.S. PATENT DOCUMENTS 6,513,466 B2 * 2/2003 Bignion et al. ..... 123/73 A
6,578,562 B1 * 6/2003 Aljabari et al. ..... 123/582
6,598,568 B2 * 7/2003 Rosskamp et al. ..... 123/73 PP
2002/0043227 A1 * 4/2002 Carlsson et al. ..... 123/73 PP
2002/0073943 A1 * 6/2002 Geyer et al. ..... 123/73 B
2002/0112681 A1 * 8/2002 Rosskamp et al. ..... 123/73 R

FOREIGN PATENT DOCUMENTS

DE 26 24 249 12/1976

* cited by examiner

*Primary Examiner*—John T. Kwon
(74) *Attorney, Agent, or Firm*—Walter Ottesen

(57) ABSTRACT

A two-stroke engine (1) has a combustion chamber (3) configured in a cylinder (2). The combustion chamber (3) is delimited by a reciprocating piston (5) and drives a crankshaft (7) which is rotatably journalled in a crankcase (4). The two-stroke engine (1) has an outlet (10) out of the combustion chamber (3) and at least one transfer channel (12, 15) which connects the crankcase (4) to the combustion chamber (3) at pregiven piston positions. The transfer channels (12, 15) open with transfer windows (13, 16) into the combustion chamber (3). To obtain a good start and good idle performance and low exhaust-gas values, an ancillary channel (14) is provided which is connected into the combustion chamber (3) at one end (37) and into the transfer channel (15) with the other end (36). During operation, the ancillary channel (14) opens into the combustion chamber (3) during the downward stroke of the piston (5) while the transfer window (16) to the combustion chamber (3) is still closed.

16 Claims, 2 Drawing Sheets

TWO-STROKE ENGINE

CROSS REFERENCE TO RELATED APPLICATION

This application claims priority of German patent application no. 103 46 048.9, filed Oct. 2, 2003, the entire content of which is incorporated herein by reference.

FIELD OF THE INVENTION

The invention relates to a two-stroke engine including a two-stroke engine in a portable handheld work apparatus such as a motor-driven chain saw, cutoff machine or the like.

BACKGROUND OF THE INVENTION

A two-stroke engine having transfer channels is disclosed in German patent publication 2,624,249. An ancillary outlet opening is provided in this two-stroke engine to reduce the development of noise during idle. The outlet is connected to the combustion chamber via this ancillary outlet opening during the downward stroke of the piston already in advance of the opening of the main outlet.

With an ancillary outlet opening of this kind, the running performance of the two-stroke engine can be improved when starting and during idle. However, the exhaust-gas values at full load of the two-stroke engine are thereby deteriorated.

SUMMARY OF THE INVENTION

It is an object of the invention to provide a two-stroke engine of the kind described above wherein an excellent running performance is provided during operation and wherein there are low exhaust-gas values at full load.

The internal combustion engine of the invention is for a portable handheld work apparatus including a motor-driven chain saw, cutoff machine, brushcutter or the like. The internal combustion engine includes: a cylinder; a piston mounted in the cylinder to undergo a reciprocating movement along a stroke path during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; an outlet for conducting exhaust gases away from the combustion chamber; at least one transfer channel for connecting the crankcase to the combustion chamber at pregiven positions of the piston; the transfer channel defining a transfer window opening into the combustion chamber; an ancillary channel having a first end opening into the combustion chamber and a second end opening into the transfer channel; the ancillary channel being open to the combustion chamber in a pregiven operating state during a downward stroke of the piston while the transfer window to the combustion chamber is still closed; and, means for opening the ancillary channel during idle and part load and for closing the ancillary channel during full load.

A decompression of the combustion chamber can take place via the ancillary channel in a pregiven operating state of the two-stroke engine, especially, during idle or part load. Because the ancillary channel opens into a transfer channel and not into the outlet, the situation is avoided that uncombusted fuel escapes from the combustion chamber into the outlet. The pregiven operating state is advantageously idle operation and part load operation. In this way, a quiet running of the engine can be achieved at idle. The idle rpm can be reduced and the idle emissions drop.

The ancillary channel opens into the combustion chamber at at least one inflow window. The upper edge of the inflow window lies approximately at the same elevation as the upper edge of the outlet or is offset relative to the upper edge of the outlet in a direction toward the combustion chamber. In each case, the upper edge of a window is the edge facing toward the combustion chamber and away from the crankcase. In this way, when opening the ancillary channel, the exhaust gas from the combustion chamber can be prestored in the transfer channel. The flow cross section of the ancillary channel is less than the flow cross section of the transfer channel. At low rpms and when starting the two-stroke engine, the small flow cross section of the ancillary channel is sufficient in order to effect a decompression in the combustion chamber and therewith make the rpm of the engine uniform and obtain an ignitable mixture in the combustion chamber. At high rpms of the two-stroke engine, the flow resistance of the ancillary channel is very high because of the high flow speeds so that the influence of the ancillary channel is minimal.

A switching device is advantageously provided for opening or closing the ancillary channel. The switching device can be manually actuated. However, it can also be practical that the switching device automatically switches the ancillary channel. The operation of the two-stroke engine is hereby simplified because the operator need not be troubled with the switching of the ancillary channel. A simple configuration of the two-stroke engine results when the switching device mechanically switches the ancillary channel. The switching device especially switches the ancillary channel in dependence upon the position of a throttle lever of the two-stroke engine. It can, however, be advantageous that the switching device controls the ancillary channel in dependence upon the rpm of the crankshaft. Here, especially a centrifugal-force controller is provided for determining the rpm.

Advantageously, the switching device pressure-control switches the ancillary channel. Especially, the switching device switches the ancillary channel in dependence upon the pressure level in different operating states of the two-stroke engine. It can, however, be practical that the two-stroke engine has a fan wheel which is fixed on the crankshaft and the switching device switches the ancillary channel in dependence upon the pressure generated by the fan wheel. A simple configuration of the switching device results when the switching device includes a valve or a flap. In order to obtain a good running performance of the two-stroke engine in all operating states, the ancillary channel is opened at idle and during starting of the engine and is closed at full load of the engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
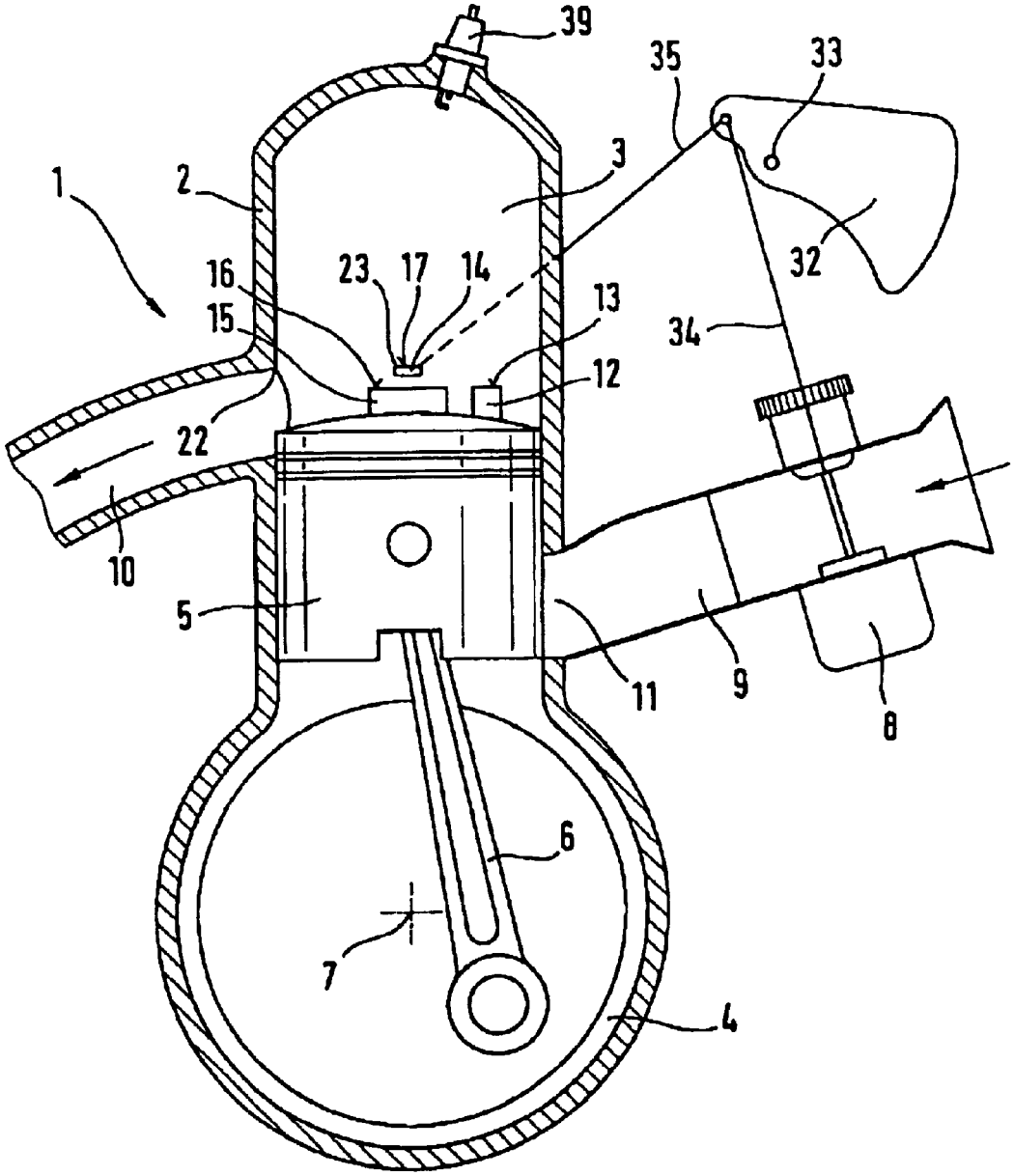
FIG. 1 is a schematic section view of a two-stroke engine.

The two-stroke engine 1 shown in FIG. 1 includes a cylinder 2 wherein a combustion chamber 3 is formed. The combustion chamber 3 is delimited by a piston 5 which is movably supported in the cylinder 2. The piston 5 drives a crankshaft 7 via a connecting rod 6. The crankshaft 7 is rotatably journalled in the crankcase 4. The two-stroke engine 1 includes an intake channel 9 wherein a carburetor 8 is mounted for the supply of an air/fuel mixture to the intake channel 9. The intake channel 9 opens into the cylinder 2 via an inlet 11.

In FIG. 1, the crankcase 4 is connected to the combustion chamber 3 via the transfer channels 12 and 15 in the position of the piston 5 shown in the region of bottom dead center. The transfer channels 12 and 15 open with transfer windows 13 and 16 into the combustion chamber 3. An ancillary channel 14 is provided which opens with the inflow window 17 into the combustion chamber 3. The ancillary channel 14 opens with one end into the combustion chamber 3 and opens with its other end into the transfer channel 15. The inflow window 17 of the ancillary channel 14 is arranged above the transfer window 16. The transfer window 16 is offset relative to the inflow window 17 in a direction toward the crankcase 4.

An outlet 10 leads out of the combustion chamber 3 for discharging exhaust gases from the combustion chamber. The upper edge 22 of the outlet 10 is arranged approximately at the elevation of the upper edge 23 of the inflow window 17. In each case, the upper edge is the control edge of the inflow window 17 and the outlet 10 with these control edges facing toward the combustion chamber 3 and away from the crankcase 4. The outlet 10 and the inflow window 17 are thereby opened by the piston 5 approximately at the same time during the downward stroke of the piston 5. The inflow window 17 can, however, also be arranged above the outlet 10 and be opened before the outlet 10 during the downward stroke of the piston 5.

The two-stroke engine 1 is mounted especially in a portable handheld work apparatus such as a cutoff machine or the like. A throttle lever 32 is provided to facilitate operator control of the two-stroke engine 1. The throttle lever 32 is pivotally journalled at a rotation point 33, for example, on the housing of the work apparatus. An actuator 34 is fixed on the throttle lever 32 and acts on the carburetor 8. The actuator 34 can, for example, adjust a throttle flap mounted in the carburetor 8. Furthermore, an actuator 35 is fixed on the throttle lever 32 which acts on a switching device (not shown in FIG. 1) of the ancillary channel 14. The switching device opens or closes the ancillary channel 14.

During operation of the two-stroke engine 1, an air/fuel mixture is drawn from the carburetor 8 into the crankcase 4 via the inlet 11 with the upward stroke of the piston 5 from the position shown in FIG. 1 in a direction toward the combustion chamber 3. The air/fuel mixture in the combustion chamber 3 is compressed therein and is ignited by the spark plug 39 in the region of top dead center of the piston 5. The piston 5 is accelerated by the combustion in a direction toward the crankcase 4 and compresses the air/fuel mixture disposed in the crankcase 4. The ancillary channel 14 is opened during idle of the two-stroke engine 1. The piston 5 opens the ancillary channel 14 approximately simultaneously with or in advance of the outlet 10 so that the exhaust gases are pressed back into the transfer channel and a decompression takes place via the transfer channel 15. As soon as the transfer windows 13 and 16 open to the combustion chamber 3, air/fuel mixture (exhaust gas is prestored ahead of the air/fuel mixture) is pressed out of the crankcase 4 and air, which is possibly prestored in the transfer channels 12 and 15, is pressed into the combustion chamber and displaces the residual exhaust gases through the outlet 10. In this way, the high scavenging losses in the pregiven operating state (especially, in idle operation and part load operation) are reduced. Because of the decompression of the combustion chamber 3, an evening out of the rpm results and therefore a quieter running of the engine 1. In this way, the exhaust-gas emissions are reduced at idle.

Figure 2:
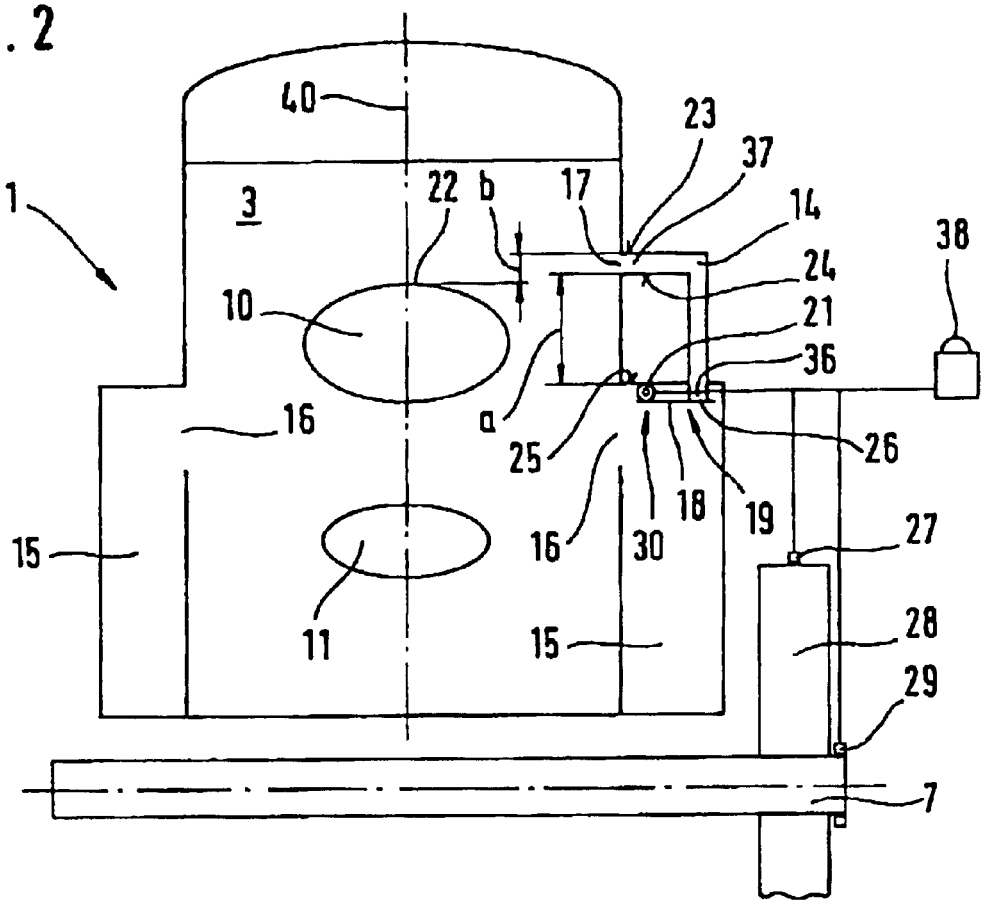
FIG. 2 is a schematic of a two-stroke engine with the ancillary channel closed.

FIG. 2 shows an embodiment for an ancillary channel 14. The flow cross section of the ancillary channel 14 is significantly less than the flow cross section of the transfer channel 15. The inflow window 17 of the ancillary channel 14 has an upper edge 23 which is offset relative to the upper edge 22 of the outlet 10 in the direction toward the combustion chamber 3. The inflow window 17 therefore opens ahead of the outlet 10 with the downward stroke of the piston 5. The upper edge 22 is at a distance (b) to the upper edge 23 in a direction of the longitudinal cylinder axis 40. The lower edge 24 of the inflow window 17 is the control edge of the inflow window 17 and faces toward the crankcase 4. The lower edge 24 is at a distance (a) in the direction of the cylinder longitudinal axis 40 to the upper edge 25 of the transfer window 16. The inflow window 17 is thereby offset relative to the transfer window 16 in the direction of the cylinder longitudinal axis 40. Both windows (16, 17) have no overlapment in the peripheral direction of the cylinder 2. The inflow window 17 is arranged at the first end 37 of the ancillary channel 14 with the end 37 facing toward the combustion chamber 3. The second end 36 of the ancillary channel 14 faces toward the crankcase 4 and opens with a port 26 into the transfer channel 15.

The two-stroke engine 1 has a switching device 30 which includes a flap 18. The flap 18 is pivotally journalled on a joint 21 and closes the port 26 of the ancillary channel 14 in the closing position 19 shown in FIG. 2.

The switching device 30 can be actuated manually by an operator via an operator-controlled element 38. The switching device 30 can, however, also be actuated automatically. For this purpose, a pressure transducer 27 is provided in the region of the fan wheel 38 of the two-stroke engine 1 with the fan wheel being fixed to the crankshaft 7. The flap 18 is opened or closed via the pressure on the pressure transducer 27. The pressure transducer 27 can, however, also determine the different pressure levels for different operating states of the two-stroke engine 1 within the engine, for example, in the crankcase 4 or in the intake channel 9.

The switching device 30 can, however, also be actuated mechanically. For this purpose, a centrifugal-force controller 29 is mounted on the crankshaft 7 and this controller causes the flap 18 to assume the closed position 19 or the open position 20 in dependence upon the rpm of the crankshaft 7. The ancillary channel 14 is open at idle and at part load and is closed at full load.

Figure 3:
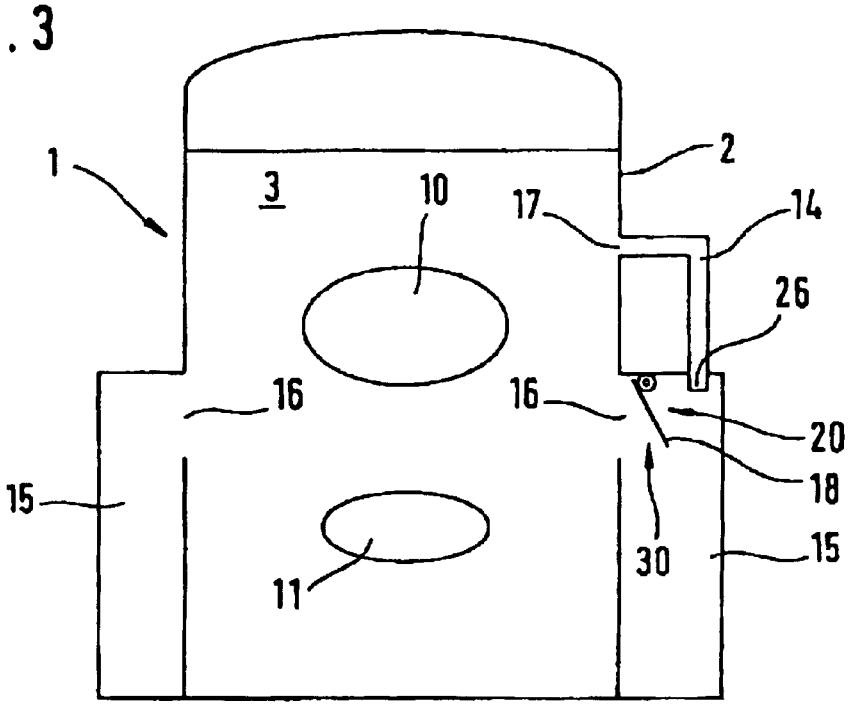
FIG. 3 shows the two-stroke engine of FIG. 2 with the ancillary channel open; and, FIG. 4 is a schematic representation of the ancillary channel of a two-stroke engine wherein a valve is disposed in the ancillary channel.

In FIG. 3, the two-stroke engine is shown with the flap 18 in the open position 20. The possibilities of actuating the switching device 30 are not shown in FIG. 3 but correspond to those in FIG. 2.

Figure 4:
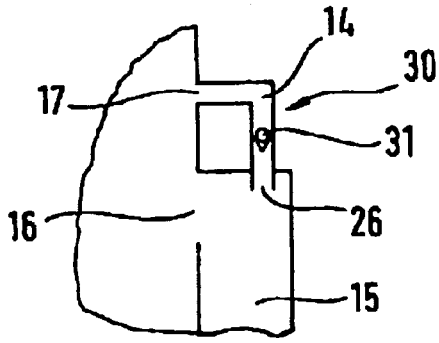

FIG. 4 shows an embodiment of an ancillary channel 14 having a switching device 30 which includes a valve 31 arranged in the ancillary channel 14. The valve 31 can be controlled via the switching device 30 in the same manner as flap 18. Other control possibilities can be provided for the switching device 30. In lieu of the flap 18 or valve 31, other elements can also be provided for opening and closing the ancillary channel 14. It can also be practical that the ancillary channel 14 is not switched. Because of the high control resistance at the high flow speeds in the case of full load, a matching of the flow cross section of the ancillary channel 14 can be sufficient. The flow cross section in the ancillary channel 14 is advantageously significantly less than the flow cross section of the transfer channel 15.

The ancillary channel 14 can be connected to one or to several and especially to all transfer channels (12, 15). When the ancillary channel 14 is connected to a transfer channel 15, it can be practical that the other transfer channels are closed at least during idle operation.

It is understood that the foregoing description is that of the preferred embodiments of the invention and that various changes and modifications may be made thereto without departing from the spirit and scope of the invention as defined in the appended claims.

What is claimed is:

1. An internal combustion engine for a portable handheld work apparatus including a motor-driven chain saw, cutoff machine, brushcutter or the like, the internal combustion engine comprising:

a cylinder;

a piston mounted in said cylinder to undergo a reciprocating movement along a stroke path during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

an outlet for conducting exhaust gases away from said combustion chamber;

at least one transfer channel for connecting said crankcase to said combustion chamber at pregiven positions of said piston;

said transfer channel defining a transfer window opening into said combustion chamber;

an ancillary channel having a first end opening into said combustion chamber and a second end opening into said transfer channel;

said ancillary channel being open to said combustion chamber in a pregiven operating state during a downward stroke of said piston while said transfer window to said combustion chamber is still closed; and, means for opening said ancillary channel during idle and part load and for closing said ancillary channel during full load.

2. The two-stroke engine of claim 1, wherein said ancillary channel opens into said combustion chamber with an inflow window.

3. The two-stroke engine of claim 2, wherein the upper edge of said inflow window lies at approximately the same elevation of said cylinder as the upper edge of said outlet.

4. The two-stroke engine of claim 2, wherein the upper edge of said inflow window is offset relative to the upper edge of said outlet in a direction toward said combustion chamber.

5. The two-stroke engine of claim 1, wherein said ancillary channel has a flow cross section less than the flow cross section of said transfer channel.

6. The two-stroke engine of claim 1, said opening means comprising a switching device for opening or closing said ancillary channel.

7. The two-stroke engine of claim 6, wherein said switching device is manually actuated.

8. The two-stroke engine of claim 6, wherein said switching device automatically switches said ancillary channel.

9. The two-stroke engine of claim 6, wherein said switching device mechanically switches said ancillary channel.

10. The two-stroke engine of claim 1, said work apparatus including a throttle lever; and, said opening means comprising: a switching device for opening or closing said ancillary channel; and, means for actuating said switching device in dependence upon the position of said throttle lever.

11. The two-stroke engine of claim 1, said opening means comprising a switching device for opening or closing said ancillary channel; and, means for actuating said switching device in dependence upon the rotational speed of said crankshaft.

12. The two-stroke engine of claim 11, said opening means further comprising a centrifugal-force controller for determining said rotational speed.

13. The two-stroke engine of claim 8, wherein said switching device pressure control switches said ancillary channel.

14. The two-stroke engine of claim 13, wherein said switching device switches said ancillary channel in dependence upon the pressure level in different operating states of said two-stroke engine.

15. The two-stroke engine of claim 13, wherein said engine includes a fan wheel fixed on said crankshaft so as to rotate therewith; and, said switching device switches said ancillary channel in dependence upon the pressure generated by said fan wheel.

16. The two-stroke engine of claim 6, wherein said switching device includes a valve or flap.

* * * * *